United States Patent [19]

Schuller

[11] 4,388,050

[45] Jun. 14, 1983

[54] MANIFOLD UNIT AND ASSEMBLY AND FLUID END ASSEMBLY

[75] Inventor: Ronald A. Schuller, Tulsa, Okla.

[73] Assignee: Geosource, Inc., Houston, Tex.

[21] Appl. No.: 248,494

[22] Filed: Mar. 27, 1981

[51] Int. Cl.[3] ..... F04B 1/00

[52] U.S. Cl. ..... 417/454; 417/539; 137/884

[58] Field of Search ..... 417/539, 454, 521; 137/884

[56] References Cited

U.S. PATENT DOCUMENTS

| | | | |
|---|---|---|---|
| 2,998,827 | 9/1961 | Cook et al. | 137/543.13 |
| 3,801,234 | 4/1974 | Love et al. | 417/454 |
| 3,989,419 | 11/1976 | Parker et al. | 417/454 |
| 4,097,202 | 6/1978 | Price | 417/454 |

FOREIGN PATENT DOCUMENTS

| | | | |
|---|---|---|---|
| 953564 | 3/1964 | United Kingdom | 137/884 |

*Primary Examiner*—Alan Cohan

*Attorney, Agent, or Firm*—Arnold, White & Durkee

[57] ABSTRACT

A suction manifold unit for mounting on a pump fluid end in association with at least one further suction manifold unit to provide a suction manifold assembly for supplying fluid to suction cylinders of such a pump fluid end. The manifold unit has at least one supply duct leading to its interior, and outlet duct for leading fluid from the supply duct to a suction cylinder during use, and a supply conduit sealingly associated with the supply duct, the supply conduit being adjustable between a retracted position where it will be spaced from another manifold unit mounted relatively to such a pump fluid end, and an extended position for engaging sealingly with a corresponding supply duct of such a further manifold unit to place the manifold units in communication with each other.

18 Claims, 3 Drawing Figures

MANIFOLD UNIT AND ASSEMBLY AND FLUID END ASSEMBLY

Figure 1:
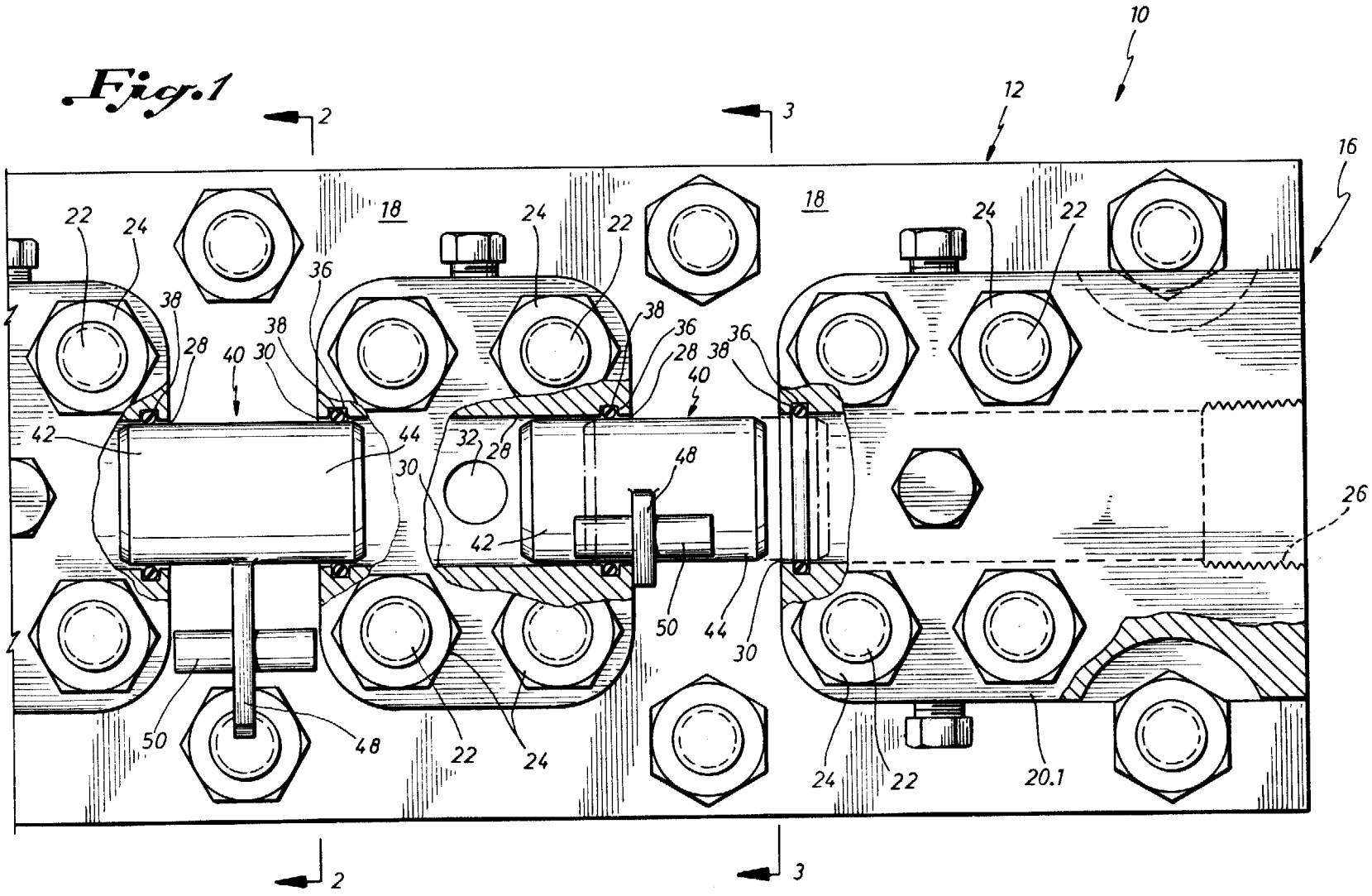

This invention relates to a manifold unit, to a manifold assembly, and to a fluid end assembly.

This invention has particular application in regard to a suction manifold unit for a pump fluid assembly, a suction manifold assembly for a pump fluid end assembly, and a pump fluid end assembly incorporating such a suction manifold assembly.

Applicants are aware of single block suction manifolds which are used with pump fluid ends including a plurality of suction cylinders. In such single block suction manifolds, a plurality of individual manifold units for cooperating with individual suction cylinders are provided as an integral part of the single block at spaced intervals along its length. Such a single block is then mounted in position on a pump fluid end for supplying fluid to be pumped to the several cylinders of the pump fluid end through the individual manifold units.

Such a single block suction manifold is mounted in position by means of bolts which bolt the block to the fluid end. The mass of the single block suction manifold and its inability to provide sufficient flexibility for the individual manifold units to accommodate clearances produced by the tolerances of the individual suction valves results in an irregular bolt loading on the single block manifold. It is thus impossible to control tolerances sufficiently accurately to provide a sufficiently flat resisting surface for the manifold units.

This system provides the further disadvantage that it gives rise to maintenance difficulties. When an individual valve, plunger or packing replacement is necessary in a single cylinder or chamber, the entire manifold block has to be disassembled causing undue labor and extra care that those valves which did not require repair or replacement, are properly located and secured during reassembly.

The alternative of resorting to separate individual manifold units which are mounted on a fluid end in association with separate suction cylinders thereof, require separate supply conduits which extend from each manifold unit to a single fluid supply source.

This leads to a maze of supply conduits which must be handled separately during assembly and disassembly, which must be of differing lengths, which must be flexible, and which present an untidy and tangled appearance with loss of compactness and with the constant risk of snagging and rupture.

It is accordingly an object of this invention to provide a system which can overcome or at least reduce some of the indicated disadvantages.

According to one aspect of the invention there is provided a suction manifold unit for mounting relatively to a pump fluid end in association with at least one further suction manifold unit to provide a suction manifold assembly for supplying fluid to suction cylinders of such a pump fluid end, the manifold unit having at least one supply duct leading to its interior, an outlet duct for leading fluid from the supply duct to a suction cylinder during use, and a supply conduit sealingly associated with the supply duct, the supply conduit being adjustable between a retracted position where it would be spaced from another manifold unit mounted relatively to such a pump fluid end, and an extended position for engaging sealingly with a corresponding supply duct of such a further manifold unit to place the manifold units in communication.

While the suction manifold unit of this invention has particular application as a suction manifold unit for a high pressure pump fluid end, and has therefore been described as such, it will be appreciated that the manifold unit and/or manifold assembly of this invention can equally have application as a discharge manifold unit or discharge manifold assembly, as the case may be, depending upon the discharge pressure of fluid which is pumped.

If the discharge pressure is sufficiently low for practical sealing means to provide a sealing effect between the supply conduit and the supply ducts, then the manifold unit and/or manifold assembly of this invention can equally be used as a discharge manifold unit and/or discharge manifold assembly.

On the other hand, where high discharge pressures will be provided, a point will be reached where the sealing requirements are such that they will offset the advantages provided by the manifold in accordance with this invention. At that stage, as a practical matter, there will be no advantage in using the manifold units and/or manifold assembly of this invention as a discharge system for a fluid end assembly.

The supply conduit may be adjustable between its retracted and extended positions by, for example, itself being telescopically extendable and retractable. Alternatively, for example, the supply conduit may be adjustable between its retracted and extended positions by being telescopically associated with the supply conduit.

In a preferred embodiment of the invention the supply conduit conveniently has a first end portion which is telescopically located within the supply conduit, and and opposed second end portion for telescopic engagement in a corresponding supply conduit of another manifold unit.

Any convenient sealing means known to those skilled in the art may be utilized to provide a sealing engagement between the supply conduit and the supply duct. In one preferred example of the invention, the sealing means comprises a sealing ring which is located in an annular groove in the supply duct to cooperate sealingly with the end portion of the supply conduit.

In a further alternative embodiment of the invention the manifold unit may include a tubular extension which extends from the supply duct, and the supply conduit may be telescopically located over the tubular extension for extension and retraction relatively to the manifold unit.

The suction manifold unit may conveniently include locating means for locating the supply conduit in its extended operative position.

Various types of locating means may be employed which are engaged with either the manifold unit or the supply conduit and which can selectively be engaged or abutted against the supply conduit or manifold unit, as the case may be to locate the supply conduit in its extended operative position.

In a preferred embodiment of the invention, the supply conduit includes an adjustment lever for use in adjusting the position of the supply conduit between its operative and inoperative positions. In this embodiment the locating means may conveniently be mounted on the adjustment lever to abut the manifold unit in its operative position for preventing displacement of the supply conduit out of its operative position, with the locating means being displaceable to clear or avoid the manifold unit and thereby permit displacement of the supply conduit into its retracted inoperative position.

In an embodiment of the invention, where the manifold unit is to be used in conjunction with a plurality of other manifold units, it may be in the form of an intermediate unit to be mounted between two further manifold units relatively to a pump fluid end. In this embodiment of the invention the suction manifold unit will include a second supply duct for sealingly engaging with a supply conduit of another manifold unit, the second supply duct being in communication with the first supply duct and with the outlet duct.

The suction manifold unit may conveniently include an outlet face to be mounted on a suction face of such a pump fluid end, with the outlet duct leading to the outlet face.

In one embodiment of the invention, the outlet face of the manifold unit may include a valve cavity for cooperating with a suction valve assembly to locate such a suction valve assembly in position between the manifold unit and a pump fluid end on which it is mounted.

The invention further extends to a suction manifold unit adapted to be mounted on a pump fluid end for supplying fluid to a suction cylinder of such a pump fluid end, the suction manifold unit having at least one supply duct leading to an interior zone of the manifold unit, an outlet duct leading from the interior zone to an outlet side of the manifold unit, and a supply conduit sealingly engaged with the supply duct, the supply conduit being selectively displaceable between a retracted position, and an extended position where it extends from the manifold unit for sealing engagement with a supply duct of a further manifold unit to thereby place the supply ducts in sealing engagement with each other.

In accordance with yet a further aspect of the invention, there is provided a manifold assembly for supplying fluid to a plurality of suction cylinders of a pump fluid end, the manifold assembly comprising at least two independent manifold units adapted to be independently mounted on such a fluid end, each manifold unit having at least one supply duct leading to its interior, and an outlet duct to lead fluid out of the manifold unit, and comprising at least one supply conduit for sealingly connecting the supply ducts of the two manifold units together to place them in communication, the supply conduit being sealingly engageable with one supply duct to be adjustable between an extended position for sealing engagement with the supply duct of the other manifold unit, and a retracted position where, in use, it would be spaced from the other manifold unit to allow independent mounting and removal of the manifold units.

Yet further according to the invention there is provided a pump fluid end assembly comprising at least two manifold units removably and independently mounted at spaced intervals on a pump fluid end for supplying fluid to suction cylinders of the fluid end, each manifold unit having a supply duct leading to its interior and an outlet duct to lead fluid from the supply duct to one suction cylinder, and comprising at least one supply conduit which is sealingly connected between the supply ducts of the two manifold units to place them in communication, the supply conduit being displaceable between its operative condition where it connects the supply ducts, and an inoperative retracted position where it is retracted relatively to one manifold unit and spaced away from the other manifold unit to permit independent removal of the manifold units.

The manifold unit, manifold assembly and fluid end assembly of this invention may be made of conventional materials suitable for the intended application and pressures.

The suction manifold unit of this invention may be mounted relatively to a pump fluid end by any appropriate means and in any suitable manner known to those skilled in the art.

Thus, for example, the suction manifold unit of this invention may be mounted relatively to a pump fluid end by being mounted directly against a suction surface of a pump fluid end, or by being mounted to a suction surface of a pump fluid end with a suction valve casing or cartridge interposed between the unit and the pump fluid end suction surface.

The manifold unit may be mounted relatively to a pump fluid end with the manifold unit incorporating, or incorporating portion of a suction valve assembly for the suction cylinder of the pump fluid end, or with the manifold unit merely locating or enclosing a suction valve assembly in position in the pump fluid end.

The manifold unit may conveniently be mounted relatively to a pump fluid end by bolts or threaded studs, as is conventionally employed in this art.

Embodiments of the invention are now described by way of example with reference to the accompanying drawings.

Figure 2:
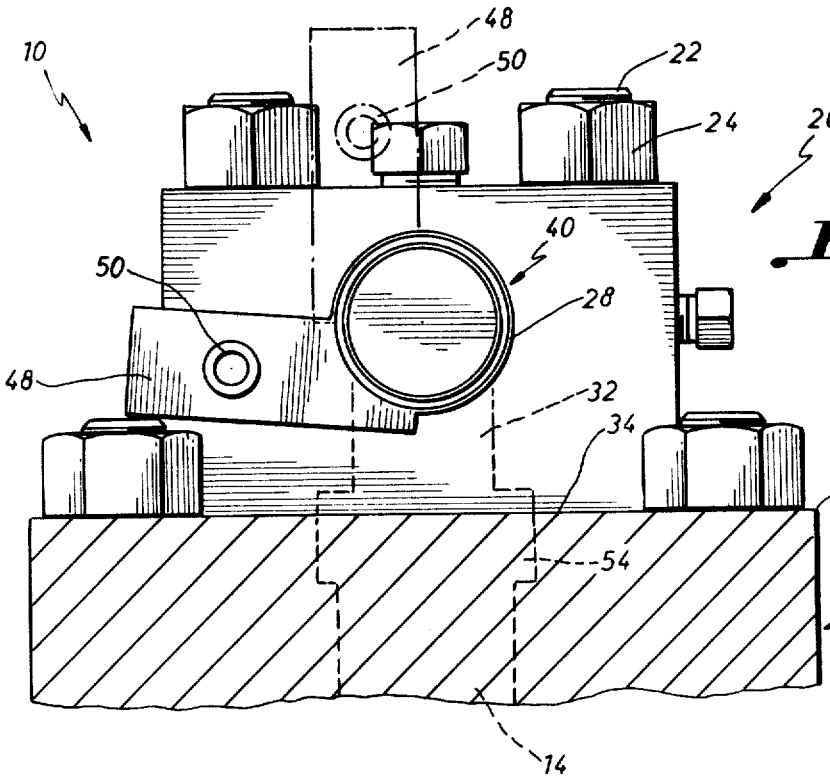
Figure 3:
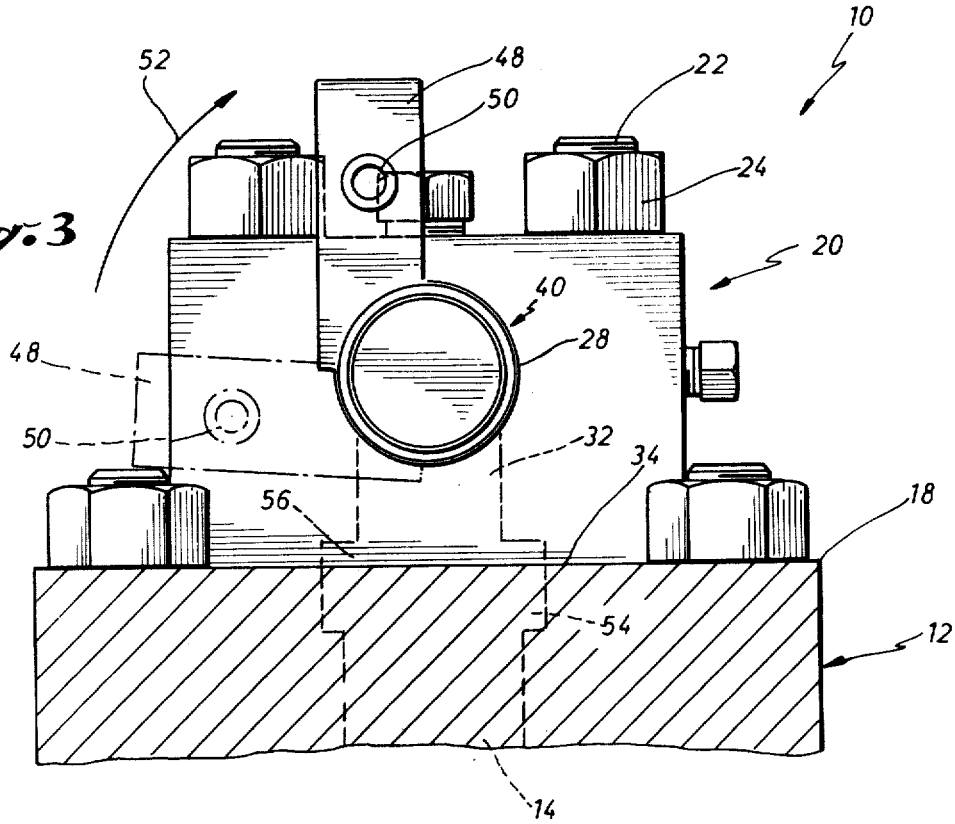

In the drawings:

FIG. 1 shows a fragmentary, partly sectional, side elevation of one embodiment of a suction manifold assembly in accordance with this invention mounted in position on a suction surface of a pump fluid end of a high pressure pump including a plurality of reciprocating plungers (not shown). FIG. 1 shows on the lefthand side a supply conduit located in its operative position and on the righthand side a supply conduit in its inoperative position;

FIG. 2 shows a cross-sectional view of the assembly of FIG. 1 along line II—II of FIG. 1 with one form of suction valve cavity for accommodating a suction valve; and FIG. 3 shows a cross-sectional view of the assembly of FIG. 1 along line III—III of FIG. 1 with an alternative form of valve cavity for accommodating a suction valve. In practice the assembly will have the same types of valve cavities for all suction valves of the assembly. The two alternative types are illustrated in the drawings for the sake of convenience only.

With reference to the drawings, reference numeral 10 refers generally to a pump fluid end assembly comprising a pump fluid end 12 of a high pressure pump having a plurality of suction cylinders 14 at laterally spaced intervals therein, for reciprocating plungers (not shown) of the high pressure pump.

The pump fluid end assembly 10 further comprises a suction manifold assembly 16 which is mounted on the suction surface 18 of the pump fluid end 12 for supplying a fluid to be pumped from a source (not shown) to the suction cylinders 14.

The pump fluid end 12 is of conventional type to constitute part of a conventional high pressure pump system.

The suction manifold assembly 16 comprises a plurality of independent suction manifold units 20 corresponding in number to the number of suction cylinders 14 of the pump fluid end 12, which are removably and independently mounted on the suction surface 18 at spaced intervals corresponding to the spacing of the suction cylinders 14.

The suction manifold units 20 are mounted on the suction surface 18 by means of threaded studs 22 and nuts 24.

The suction manifold unit identified by reference 20.1 constitutes a leading suction manifold unit and differs from the remaining suction manifold units 20.2, 20.3 etc.

The leading suction manifold unit 20.1 has an inlet duct 26 for use in coupling the unit 20.1 to a source of liquid to be supplied to the suction cylinders 14.

Each of the remaining suction manifold units 20.2, 20.3, etc. has a first supply duct 28 which leads into its interior from one side of the manifold unit 20, and a second corresponding supply duct 30 which corresponds to the first supply duct 28 and leads into the interior of the manifold unit 20 from the opposed side thereof. The first and second supply ducts 28 and 30 are aligned with each other and in communication with each other.

Each manifold unit 20.2, 20.3 etc. further has an outlet duct 32 which leads from the supply ducts 28 and 30 to an outlet surface 34 of the manifold unit to lead fluid being supplied to the manifold units 20 from the supply ducts 28 and 30 to the suction cylinders 14.

The leading suction manifold unit 20.1 differs from the remaining manifold units 20.2, 20.3 etc. in that it has only a single second supply duct 30 which is in communication with the inlet duct 26. However, the leading suction manifold unit 20.1 has an outlet duct corresponding to the outlet ducts 32 of the remaining manifold units.

Each supply duct 28 and 30 has an annular groove 36 wherein an annular sealing ring 38 is located.

The suction manifold assembly 16 further comprises a plurality of rigid supply conduits 40 for placing the successive manifold units 20 of the manifold assembly 16 in communication.

Each supply conduit 40 is cylindrical and has a first end portion 42 and an opposed corresponding second end portion 44.

Each supply conduit 40 is located in its operative position, as shown in the lefthand part of FIG. 1 between adjacent pairs of manifold units 20.2 and 20.3, by having its first end portion 42 telescopically located within the first supply duct 28 and by having its second end portion 44 telescopically located within the second supply duct 30.

The end portions 42 and 44 engage sealingly with the sealing rings 38 to thereby provide a sealed communication between the adjacent pairs of manifold units 20.2 and 20.3 etc.

As shown in the righthand side of FIG. 1 between the manifold units 20.1 and 20.2, each supply conduit 40 is displaceable from its operative position into a retracted inoperative position where the end portion 42 has, for example, being telescopically retracted into the first supply duct 28 of the manifold unit 20.2.

During such retraction the end portion 44 of that supply conduit 40 is withdrawn from the second supply duct 30 of the manifold unit 20.1 thereby releasing the engagement between the manifold units 20.1 and 20.2. This permits independent removal and mounting of such separated manifold units.

Each supply conduit 40 includes a lever 48 for use in displacing the conduit between its operative and inoperative positions.

The lever 48 in integrally connected to the supply conduit 40 and extends therefrom in a direction transversely to the axis of the supply conduit 40.

Each supply conduit further includes locating means in the form of a locating bar 50 for locating the supply conduit 40 in its operative condition to prevent inadvertent displacement of such a conduit 40 out of its operative condition.

Each locating bar 50 is mounted on a lever 48 and has a length corresponding substantially to the spacing between adjacent manifold units 20.

In use, for displacing a supply conduit 40 from its operative condition into its inoperative condition, the lever 48 may be grasped and displaced in a direction away from the suction surface 18 as indicated by the arrow 52 in FIG. 3.

During such displacement of the lever 48 its supply conduit 40 will be pivotally displaced about its axis through an arc of 90°.

Such displacement of the lever 48 will at the same time cause the locating bar 50 to be displaced from its operative position where it lies between two adjacent manifold units 20, and its inoperative position where it lies above the outer periphery of the manifold units 20 to clear the manifold units 20.

Once the locating bar 50 has cleared the manifold units 20, the supply conduit 40 can, via the lever 48, be displaced axially to be retracted telescopically into the first supply duct 28, or into the second supply duct 30, of a manifold unit such as the unit 20.2 and thus withdrawn from the second supply duct 30 or first supply duct 28 as the case may be, of the adjacent manifold unit 20.

This therefore provides the advantage that the independent manifold units 20 can be mounted independently on the suction surface 18 to provide even bolt loading and an effective sealing location of the outlet surfaces 34 of the manifold units 20 on the suction surface 18 of the pump fluid end 12.

Thereafter the successive manifold units 20 can be placed in sealed communication with each other by displacing the successive supply conduits 40 into their operative positions.

Since the successive manifold units are in sealed communication with each other, fluid to be pumped from a single supply source can be supplied through the inlet duct 26 of the leading suction manifold unit 20.1 and then to the supply ducts 28 and 30 and outlet ducts 32 of the successive manifold units.

It will be appreciated that the manifold unit 20 which will be provided at the downstream end of the manifold units relatively to the supply path of fluid to be pumped, will have its second supply duct 30 plugged with an appropriate plug.

When any individual manifold unit 20 requires replacement or repair, or when access is necessary to the suction valve assembly or to the plunger or packing of the suction cylinder 14 with which that manifold unit 20 is cooperating, the supply conduits 40 engaged with that manifold unit 20 can be displaced into their inoperative positions. The released manifold unit 20 can then be removed independently without disturbing the remaining manifold units.

The embodiment of the invention as illustrated in the drawings provides the advantage that independent manifold units can be placed in communication with each other in a compact and effective manner. There is no need for a plurality of separate supply conduits which must, as a practical matter, usually be flexible and of differing lengths, and which destroy the compactness of the manifold assembly.

The embodiment of the invention as illustrated in the drawings provides the further advantage that it permits uniform tightening of the separate manifold units 20 to the pump fluid end 12 thereby eliminating uneven loading. This will not only tend to improve fatigue life but allows individual suction valve, plunger and packing maintenance when required.

In the one embodiment of the invention typified by the cross-section shown in FIG. 2, the suction cylinders 14 of the pump fluid end 12 are provided with counterbored cavities 54 extending inwardly from the suction surface 18 for accommodating suction valve assemblies. In this embodiment, the suction manifold unit 20 merely serves to extend over and locate any suction valve assembly in position in the cavity 54.

In the alternative embodiment of the invention, as typified by the cross-section indicated in FIG. 3, not only does the pump fluid end 12 include counterbored cavities 54 for accommodating a portion of the suction valve assemblies, but each manifold unit 20 includes a corresponding counterbored cavity 56 for accommodating matter portion of such a suction valve assembly.

It will be appreciated that conventional sealing means will, where required, be provided between the engaging outlet surfaces 34 and suction surface 18 of the manifold units 20 and the pump fluid end 12.

What is claimed is:

1. A suction manifold unit for mounting relatively to a pump fluid end in association with at least one further suction manifold unit to provide a suction manifold assembly for supplying fluid to suction cylinders of such a pump fluid end, the manifold unit having at least one supply duct leading to its interior, an outlet duct for leading fluid from the supply duct to a suction cylinder during use, and a supply conduit sealingly associated with the supply duct, the supply conduit being adjustable between a retracted position where it would be spaced from another manifold unit mounted relatively to such a pump fluid end, and an extended position for engaging sealingly with a corresponding supply duct of such a further manifold unit to place the manifold units in communication.

2. A suction manifold unit according to claim 1, in which the supply conduit is adjustable between its retracted and extended positions by being telescopically associated with the supply conduit.

3. A suction manifold unit according to claim 2, in which the supply conduit has a first end portion which is telescopically located within the supply conduit, and has an opposed second end portion for telescopic engagement in a corresponding supply conduit of another manifold unit.

4. A suction manifold unit according to claim 3, in which the supply conduit includes sealing means located in an annular groove to cooperate sealingly with the end portion of the supply conduit.

5. A suction manifold unit according to claim 1, including locating means for locating the supply conduit in its extended position.

6. A suction manifold unit according to claim 5, including an adjustment lever for use in adjusting the position of the supply conduit.

7. A suction manifold unit according to claim 6, in which the locating means is mounted on the adjustment lever and in which the adjustment lever is displaceable between an unlocked condition, and a locked condition where the locating means cooperates with the manifold unit to locate the supply conduit in its extended position.

8. A suction manifold unit according to claim 1, in which the unit is in the form of an intermediate unit to be mounted between two further manifold units relatively to a pump fluid end, and in which the suction manifold unit has a second supply duct for sealingly engaging with a supply conduit of another manifold unit, the second supply duct of the manifold unit being in communication with its other supply duct and with its outlet duct.

9. A suction manifold unit according to claim 1, including an outlet face to be mounted on a suction face of such a pump fluid end, with the outlet duct leading to the outlet face.

10. A suction manifold unit according to claim 9, in which the outlet face includes a valve cavity for cooperating with a suction valve assembly to locate such a suction valve assembly in position between the manifold unit and such a pump fluid end.

11. A manifold assembly for supplying fluid to a plurality of suction cylinders of a pump fluid end, the manifold assembly comprising at least two independent manifold units adapted to be independently mounted on such a fluid end, each manifold unit having at least one supply duct leading to its interior, and an outlet duct to lead fluid out of the manifold unit, and comprising at least one supply conduit for sealingly connecting the supply ducts of the two manifold units together to place them in communication, the supply conduit being sealingly engageable with one supply duct to be adjustable between an extended position for sealing engagement with the supply duct of the other manifold unit, and a retracted position where, in use, it would be spaced from the other manifold unit to allow independent mounting and removal of the manifold units.

12. A manifold assembly according to claim 11, in which the supply conduit has a first end portion which is telescopically engageable with one supply duct, and a second end portion which is telescopically engageable with the other supply duct when the supply conduit is telescopically extended.

13. A manifold assembly according to claim 11, including a plurality of independent manifold units and a plurality of supply conduits for connecting the units together, at least one manifold unit comprising a leading manifold unit for connection to a source of fluid, and each remaining manifold unit having a pair of supply ducts which are in communication with each other and with the outlet duct to allow one supply duct to be connected by means of a supply conduit to a supply duct of an upstream manifold unit during use, and to allow the other supply duct to be connected by means of a supply conduit to a supply duct of a downstream manifold unit during use.

14. A pump fluid end assembly comprising at least two manifold units removably and independently mounted at spaced intervals on a pump fluid end for supplying fluid to suction cylinders of the fluid end, each manifold unit having a supply duct leading to its interior and an outlet duct to lead fluid from the supply duct to one suction cylinder, and comprising at least one supply conduit which is sealingly connected between the supply ducts of the two manifold units to place them in communication, the supply conduit being displaceable between its operative condition where it connects the supply ducts, and an inoperative retracted position where it is retracted relatively to one manifold unit and spaced away from the other manifold unit to permit independent removal of the manifold units.

15. An assembly according to claim 14, in which the supply conduit has opposed end portions which are telescopically located in the supply ducts of the two manifold units, and in which the supply conduit is retracted by telescopingly displacing the one end portion into one supply duct to thereby withdraw the opposed end portion from the other supply duct.

16. An assembly according to claim 15, in which the supply conduit includes a lever for use in displacing the conduit, and locating means for locating the conduit in its operative condition.

17. An assembly according to claim 16, in which the locating means is adapted to abut the manifold units to prevent displacement of the conduit out of its operative position, and in which the locating means is displaceable to clear the manifold units and thus permit displacement of the conduit.

18. An assembly according to any one of claims 14 to 17, including a plurality of manifold units which are mounted on the pump fluid end for each unit to cooperate with one suction cylinder, one manifold unit comprising a leading unit for connection to a source of fluid, and each remaining unit having a pair of supply ducts which are in communication with each other and with the outlet duct with one supply duct being removably connected to the supply duct of an upstream manifold unit by means of a supply conduit, and with the other supply duct being removably connected to the supply duct of a downstream manifold unit by means of a further supply conduit.

* * * * *